US010409201B2

(12) United States Patent
Kato

(10) Patent No.: US 10,409,201 B2
(45) Date of Patent: Sep. 10, 2019

(54) IMAGE FORMING APPARATUS AND CONTROL METHOD OF ADJUSTING CLEANER BRUSH POLARITIES OF CLEANING UNIT OF IMAGE FORMING APPARATUS

(71) Applicant: KONICA MINOLTA, INC., Chiyoda-ku, Tokyo (JP)

(72) Inventor: Tomohiro Kato, Okazaki (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 16/102,142

(22) Filed: Aug. 13, 2018

(65) Prior Publication Data

US 2019/0064709 A1 Feb. 28, 2019

(30) Foreign Application Priority Data

Aug. 31, 2017 (JP) ..... 2017-166905

(51) Int. Cl.
*G03G 21/00* (2006.01)
*G03G 15/16* (2006.01)
*G03G 15/00* (2006.01)

(52) U.S. Cl.
CPC ..... *G03G 15/161* (2013.01); *G03G 15/553* (2013.01); *G03G 21/0035* (2013.01); *G03G 21/0076* (2013.01); *G03G 2215/1657* (2013.01); *G03G 2215/1661* (2013.01); *G03G 2221/001* (2013.01)

(58) Field of Classification Search
CPC .. G03G 15/161; G03G 15/168; G03G 15/553; G03G 21/0035; G03G 21/0076; G03G 2215/1647; G03G 2215/1661; G03G 2215/001; G03G 2215/0073
USPC ..... 399/34, 101, 354
See application file for complete search history.

(56) References Cited

U.S. PATENT DOCUMENTS 8,259,353 B2 * 9/2012 Hamaya ..... H04N 1/00885 347/111
2007/0036578 A1 * 2/2007 Fukami ..... G03G 15/168 399/101
2008/0056740 A1 * 3/2008 Inukai ..... G03G 15/55 399/37
2008/0273891 A1 * 11/2008 Hamada ..... G03G 15/161 399/71
2014/0321874 A1 * 10/2014 Sugiura ..... G03G 21/0035 399/71

FOREIGN PATENT DOCUMENTS

JP 2006251028 A 9/2006
JP 2009258541 A * 11/2009

* cited by examiner

*Primary Examiner* — Robert B Beatty
(74) *Attorney, Agent, or Firm* — Buchanan Ingersoll & Rooney PC

(57) ABSTRACT

An image forming apparatus includes: an image carrier that carries a toner image; a cleaning unit that collects a toner on the image carrier; and a hardware processor that controls the cleaning unit, wherein the cleaning unit includes a first cleaner brush and a second cleaner brush that remove the toner from the image carrier, and the hardware processor applies bias voltages having opposite polarities to the first cleaner brush and the second cleaner brush, and determines whether life is ended with respect to each of the first cleaner brush and the second cleaner brush.

12 Claims, 18 Drawing Sheets

FIG. 5

151

| ABSOLUTE HUMIDITY X [g/m³] | LIFE THRESHOLD [v] |
|---|---|
| X≦1 | 2500 |
| 1<X≦2 | 2500 |
| 2<X≦3 | 2400 |
| 3<X≦4 | 2350 |
| 4<X≦5 | 2200 |
| 5<X≦6.5 | 2150 |
| 6.5<X≦8 | 2050 |
| 8<X≦10 | 2000 |
| 10<X≦12 | 1900 |
| 12<X≦14 | 1800 |
| 14<X≦16 | 1750 |
| 16<X≦18 | 1700 |
| 18<X≦21 | 1600 |
| 21<X≦24 | 1550 |
| 24<X≦28 | 1500 |
| 28<X | 1500 |

FIG. 14

251

| ABSOLUTE HUMIDITY X [g/m³] | LIFE THRESHOLD [v] | |
|---|---|---|
| | NORMAL LIFE | SINGLE COLOR PRINTING LIFE |
| X≦1 | 2500 | 2650 |
| 1<X≦2 | 2500 | 2650 |
| 2<X≦3 | 2400 | 2550 |
| 3<X≦4 | 2350 | 2500 |
| 4<X≦5 | 2200 | 2350 |
| 5<X≦6.5 | 2150 | 2300 |
| 6.5<X≦8 | 2050 | 2200 |
| 8<X≦10 | 2000 | 2150 |
| 10<X≦12 | 1900 | 2050 |
| 12<X≦14 | 1800 | 1950 |
| 14<X≦16 | 1750 | 1900 |
| 16<X≦18 | 1700 | 1850 |
| 18<X≦21 | 1600 | 1750 |
| 21<X≦24 | 1550 | 1700 |
| 24<X≦28 | 1500 | 1650 |
| 28<X | 1500 | 1650 |

FIG. 19

351

| ABSOLUTE HUMIDITY X [g/m³] | LIFE THRESHOLD [V] | |
|---|---|---|
| | TWO-TIME APPLICATION | NORMAL LIFE |
| X≦1 | 2400 | 2500 |
| 1<X≦2 | 2400 | 2500 |
| 2<X≦3 | 2300 | 2400 |
| 3<X≦4 | 2250 | 2350 |
| 4<X≦5 | 2100 | 2200 |
| 5<X≦6.5 | 2050 | 2150 |
| 6.5<X≦8 | 1950 | 2050 |
| 8<X≦10 | 1900 | 2000 |
| 10<X≦12 | 1800 | 1900 |
| 12<X≦14 | 1700 | 1800 |
| 14<X≦16 | 1650 | 1750 |
| 16<X≦18 | 1600 | 1700 |
| 18<X≦21 | 1500 | 1600 |
| 21<X≦24 | 1450 | 1550 |
| 24<X≦28 | 1400 | 1500 |
| 28<X | 1400 | 1500 |

IMAGE FORMING APPARATUS AND CONTROL METHOD OF ADJUSTING CLEANER BRUSH POLARITIES OF CLEANING UNIT OF IMAGE FORMING APPARATUS

The entire disclosure of Japanese patent Application No. 2017-166905, filed on Aug. 31, 2017, is incorporated herein by reference in its entirety.

BACKGROUND

Technological Field

The present disclosure relates to an image forming apparatus, and more particularly, to a cleaning unit provided in an image forming apparatus.

Description of the Related Art

Electrophotographic type image forming apparatuses have become widespread. An electrophotographic image forming apparatus performs, as a printing step, steps of forming a toner image corresponding to an input image on a photoreceptor, primarily transferring the toner image on the photoreceptor onto a transfer belt, secondarily transferring the toner image on the transfer belt onto a sheet, and thermally fixing the toner image on the sheet by a fixing apparatus.

After the step of secondarily transferring the toner image on the transfer belt onto the sheet, it is necessary to clean the toner remaining on the transfer belt in preparation for the subsequent image formation. As an example of a technique related to the cleaning of the transfer belt, JP 2006-251028 A discloses a technology that "a cleaning voltage is applied to a conductive brush roller, and a cleaning condition is controlled so as to be changed on the basis of a magnitude of a cleaning current flowing due to the application of the cleaning voltage and a magnitude of an electric potential of a conductive counter roller (see [Solving Means] of [Abstract of the Disclosure]).

With the recent improvement in the performance of cleaning units, the rotation speed of a cleaner brush is rising. As a result, abrasion of a cleaner brush is accelerated, and maintenance work of a cleaning unit frequently occurs. Therefore, there is a demand for a technology for reducing burden due to the maintenance of a cleaning unit in an image forming apparatuses.

SUMMARY

The present disclosure has been devised in view of such circumstances, and an object in a certain aspect is to provide a cleaning unit that realizes cost reduction and labor saving of maintenance of an image forming apparatus.

To achieve the abovementioned object, according to an aspect of the present invention, an image forming apparatus reflecting one aspect of the present invention comprises an image carrier that carries a toner image; a cleaning unit that collects a toner on the image carrier; and a hardware processor that controls the cleaning unit, wherein the cleaning unit includes a first cleaner brush and a second cleaner brush that remove the toner from the image carrier, and the hardware processor applies bias voltages having opposite polarities to the first cleaner brush and the second cleaner brush, and determines whether life is ended with respect to each of the first cleaner brush and the second cleaner brush.

BRIEF DESCRIPTION OF THE DRAWINGS

The objects, advantages, aspects, and features provided by one or more embodiments of the invention will become more fully understood from the detailed description given hereinbelow and the appended drawings which are given by way of illustration only, and thus are not intended as a definition of the limits of the present invention:

FIG. 5 is a diagram showing threshold information used in the life determination;

FIG. 14 is a diagram showing threshold information used in printing life determination of a single color image;

FIG. 19 is a diagram showing threshold information used in the fourth embodiment.

DETAILED DESCRIPTION OF EMBODIMENTS

Figure 1:
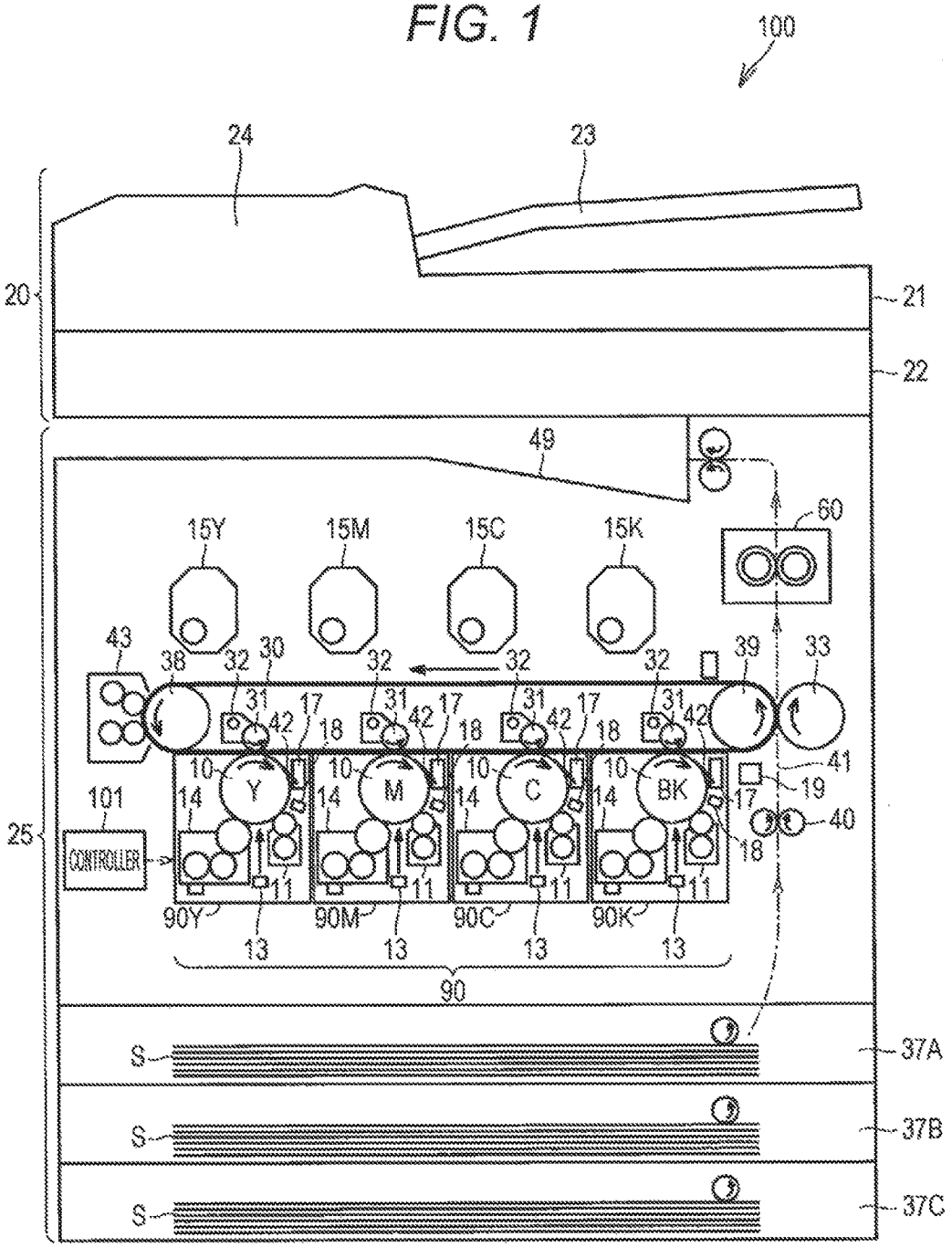
FIG. 1 is a diagram showing an example of an overall structure of an image forming apparatus.

Hereinafter, one or more embodiments of the present invention will be described with reference to the drawings. However, the scope of the invention is not limited to the disclosed embodiments. In the following description, the same parts and constituent elements are denoted by the same reference numerals. Names and functions thereof are also the same. Therefore, detailed description of these will not be repeated. Note that each embodiment and each modification described below may be selectively combined as appropriate.

First Embodiment

[1. Configuration of Image Forming Apparatus 100]

An image forming apparatus 100 according to an embodiment will be described with reference to FIG. 1. FIG. 1 is a diagram showing an example of an overall structure of the image forming apparatus 100.

FIG. 1 shows the image forming apparatus 100 as a color printer. Hereinafter, the image forming apparatus 100 as a color printer will be described. However, the image forming apparatus 100 is not limited to a color printer. For example, the image forming apparatus 100 may be a monochrome printer, or may be a multifunction machine (so-called multi functional peripheral (MFP)) of a monochrome printer or a color printer and a facsimile machine.

The image forming apparatus 100 includes: a scanner 20 as an image reading unit; and a printer 25 including an image forming part 90 (specifically, 90Y, 90M, 90C, 90K). The scanner 20 includes a cover 21, a sheet table 22, a tray 23, and an auto document feeder (ADF) 24. One end of the cover 21 is fixed to the sheet table 22, and the cover 21 can be opened and closed with the one end as a fulcrum.

A user of the image forming apparatus 100 can set a document on the sheet table 22 by opening the cover 21. When accepting a scan instruction in a state where the document is set on the sheet table 22, the image forming apparatus 100 starts scanning of the document set on the sheet table 22. When the image forming apparatus 100 accepts the scan instruction in a state where the document is set on the tray 23, the ADF 24 automatically reads the document sheet by sheet.

The printer 25 includes image forming parts 90Y, 90M, 90C, 90K, an image density control (IDC) sensor 19, a transfer belt 30, a primary transfer roller 31, a transfer driver 32, a secondary transfer roller 33, cassettes 37A to 37C, a driven roller 38, a driving roller 39, a timing roller 40, a cleaning unit 43, a fixing device 60, and a controller 101.

The image forming parts 90Y, 90M, 90C, 90K are arrayed in order along the transfer belt 30. The image forming part 90Y receives a toner supply from a toner bottle 15Y to form a yellow (Y) toner image. The image forming part 90M receives toner supply from a toner bottle 15M to form a magenta (M) toner image. The image forming part 90C receives toner supply from a toner bottle 15C to form a cyan (C) toner image. The image forming part 90K receives toner supply from a toner bottle 15K to form a black (BK) toner image.

The image forming parts 90Y, 90M, 90C, 90K are arranged in order of the rotation direction of the transfer belt 30 along the transfer belt 30. Each of the image forming parts 90Y, 90M, 90C, 90K includes a photoreceptor 10 being rotatable, a charging device 11, an exposing device 13, a developing device 14, a cleaning unit 17, and a toner sensor 18.

After each of the image forming parts 90Y, 90M, 90C, 90K operates as described above, the yellow (Y) toner image, the magenta (M) toner image, the cyan (C) toner image, and the black (BK) toner image are sequentially superimposed by transferring by the transfer driver 32, and transferred from the photoreceptor 10 to the transfer belt 30. As a result, a color toner image is formed on the transfer belt 30.

The IDC sensor 19 detects the density of a toner image 35 formed on the transfer belt 30. Typically, the IDC sensor 19 is a light intensity sensor composed of a reflection type photosensor, and detects the intensity of reflected light from a surface of the transfer belt 30.

The transfer belt 30 is stretched around the driven roller 38 and the driving roller 39. The driving roller 39 is connected to a motor (not shown). When the controller 101 controls the motor, the driving roller 39 rotates. The transfer belt 30 and the driven roller 38 rotate in conjunction with the driving roller 39. As a result, the toner image 35 on the transfer belt 30 is sent to the secondary transfer roller 33.

Sheets of different sizes are set in each of the cassettes 37A to 37C. The sheet is an example of a recording medium. The sheet is sent from any of the cassettes 37A to 37C one by one to the secondary transfer roller 33 along a conveying path 41 by the timing roller 40. The controller 101 controls a transfer voltage to be applied to the secondary transfer roller 33 in accordance with the timing at which the sheet is sent out.

The secondary transfer roller 33 applies a transfer voltage having a polarity opposite from a charging polarity of the toner image 35 to the sheet being conveyed. As a result, the toner image 35 is attracted to the secondary transfer roller 33 from the transfer belt 30, and the toner image 35 on the transfer belt 30 is transferred. The timing of conveying the sheet to the secondary transfer roller 33 is controlled by the timing roller 40 in accordance with a position of the toner image 35 on the transfer belt 30. As a result, the toner image 35 on the transfer belt 30 is transferred to an appropriate position on the sheet.

The fixing device 60 pressurizes and heats the sheet passing through the fixing device 60. As a result, the toner image is fixed on the sheet. Thereafter, the sheet is discharged to a tray 49.

The cleaning unit 43 collects the toner remaining on the surface of the transfer belt 30 after transferring the toner image from the transfer belt 30 to the sheet. The collected toner is conveyed by a conveying screw (not shown) and stored in a waste toner container (not shown). Details of the cleaning unit 43 will be described later.

[2. Hardware Configuration]

Figure 2:
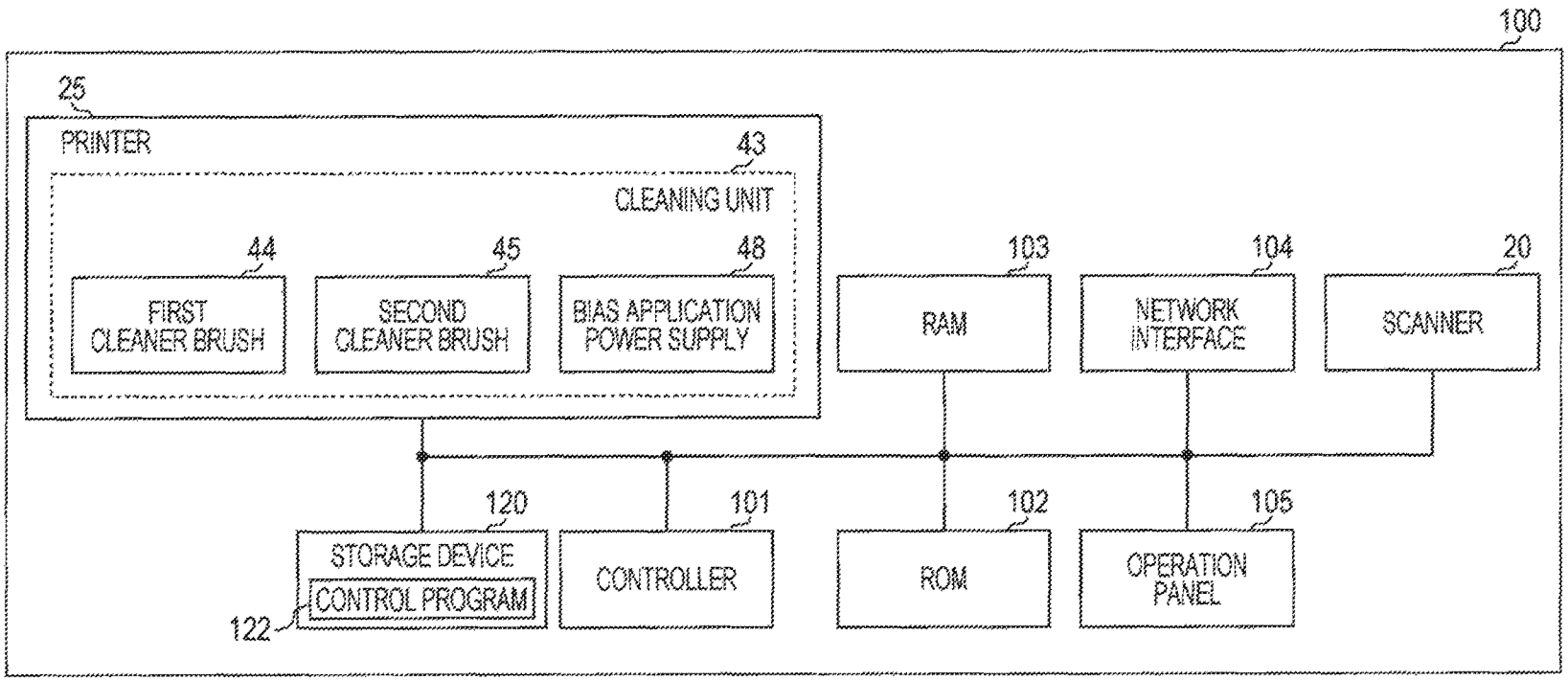
FIG. 2 is a block diagram showing a main hardware configuration of the image forming apparatus.

An example of a hardware configuration of the image forming apparatus 100 will be described with reference to FIG. 2. FIG. 2 is a block diagram showing the main hardware configuration of the image forming apparatus 100.

As shown in FIG. 2, the image forming apparatus 100 includes, in addition to the scanner 20 and the printer 25, a controller 101, a read only memory (ROM) 102, a random access memory (RAM) 103, a network interface 104, an operation panel 105, and a storage device 120.

The controller 101 is composed of for example, at least one integrated circuit. The integrated circuit is composed of, for example, at least one central processing unit (CPU), at least one application specific integrated circuit (ASIC), at least one field programmable gate array (FPGA), or a combination thereof.

The controller 101 controls the operation of the image forming apparatus 100 by executing various programs such as a program 122 for adjusting control parameters of the image forming apparatus 100. The controller 101 reads the program 122 from the storage device 120 to the RAM 103 on the basis of accepting an execution instruction of the program 122. The RAM 103 functions as a working memory and temporarily stores various data necessary for executing the program 122.

An antenna (not shown) and the like are connected to the network interface 104. The image forming apparatus 100 exchanges data with an external communication device via the antenna. The external communication device includes, for example, a mobile communication terminal such as a smartphone, a server, and the like. The image forming apparatus 100 may be configured so that the program 122 can be downloaded from the server via the antenna.

The operation panel 105 is composed of a display and a touch panel. The display and the touch panel are overlapped with each other and accept operation on the image forming apparatus 100 by touch operation. As an example, the operation panel 105 accepts operation for performing adjustment processing of the control parameters and the like.

The storage device 120 is, for example, a hard disk, a solid state drive (SSD), or other storage device. The storage device 120 may be either a built-in type or an external type. The storage device 120 stores the program 122 and the like according to the present embodiment. However, a storage location of the program 122 is not limited to the storage device 120, and may be stored in a storage region (for example, a cache) of the controller 101, the ROM 102, the RAM 103, an external device (for example, a server), or the like.

The program 122 may be provided by being incorporated into a part of an arbitrary program, not as a single program. In this case, the control processing according to the present embodiment is realized in cooperation with an arbitrary program. Programs not including some of such modules do not depart from the gist of the program 122 according to the present embodiment.

Some or all of the functions provided by the program 122 may be realized by dedicated hardware. The image forming apparatus 100 may be configured in a form like a so-called cloud service in which at least one server performs part of the processing of the program 122.

[3. Cleaning Unit 43]

Figure 3:
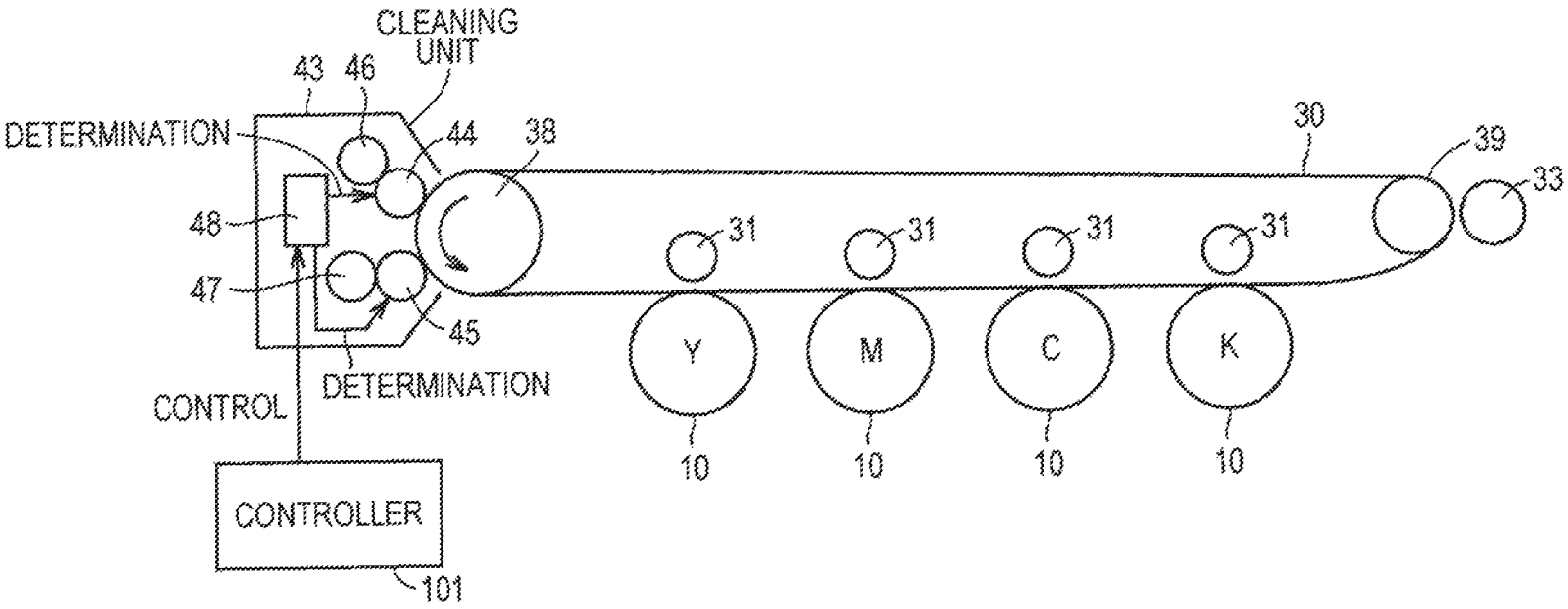
FIG. 3 is a diagram showing a configuration of a cleaning unit.

The cleaning unit 43 included in the image forming apparatus 100 will be described with reference to FIG. 3. FIG. 3 is a diagram showing a configuration of the cleaning unit 43.

As shown in FIG. 3, the cleaning unit 43 includes a first cleaner brush 44, a second cleaner brush 45, a first collection roller 46, a second collection roller 47, and a bias application power supply 48.

The first cleaner brush 44 comes into contact with an upstream side of the driven roller 38 of the transfer belt 30, and removes a toner T from the transfer belt 30 by electrostatic attraction by a bias voltage described later. The toner that has been removed from the transfer belt 30 by the first cleaner brush 44 is collected by the first collection roller 46.

The second cleaner brush 45 comes into contact with a downstream side of the driven roller 38 of the transfer belt 30, and removes the toner T from the transfer belt 30 by electrostatic attraction by a bias voltage described later. The toner that has been removed from the transfer belt 30 by the second cleaner brush 45 is collected by the second collection roller 47.

The bias application power supply 48 is controlled by the controller 101 and applies a bias voltage to the first cleaner brush 44 and the second cleaner brush 45. The bias application power supply 48 can apply a voltage of the same polarity as and a voltage of the opposite polarity from the charging polarity of the toner T.

In one aspect, the toner T on the transfer belt 30 contains both plus and minus charging polarities. The controller 101 controls the bias application power supply 48 to apply bias voltages having opposite polarities to the first cleaner brush 44 and the second cleaner brush 45. Both the plus-charged toner and the minus-charged toner remaining on the transfer belt 30 are reliably removed by the first cleaner brush 44 and the second cleaner brush 45.

The controller 101 determines whether the life is ended for each of the first cleaner brush 44 and the second cleaner brush 45. Life determination of the first cleaner brush 44 and the second cleaner brush 45 by the controller 101 will be described below.

[4. Life Determination]

Figure 4:
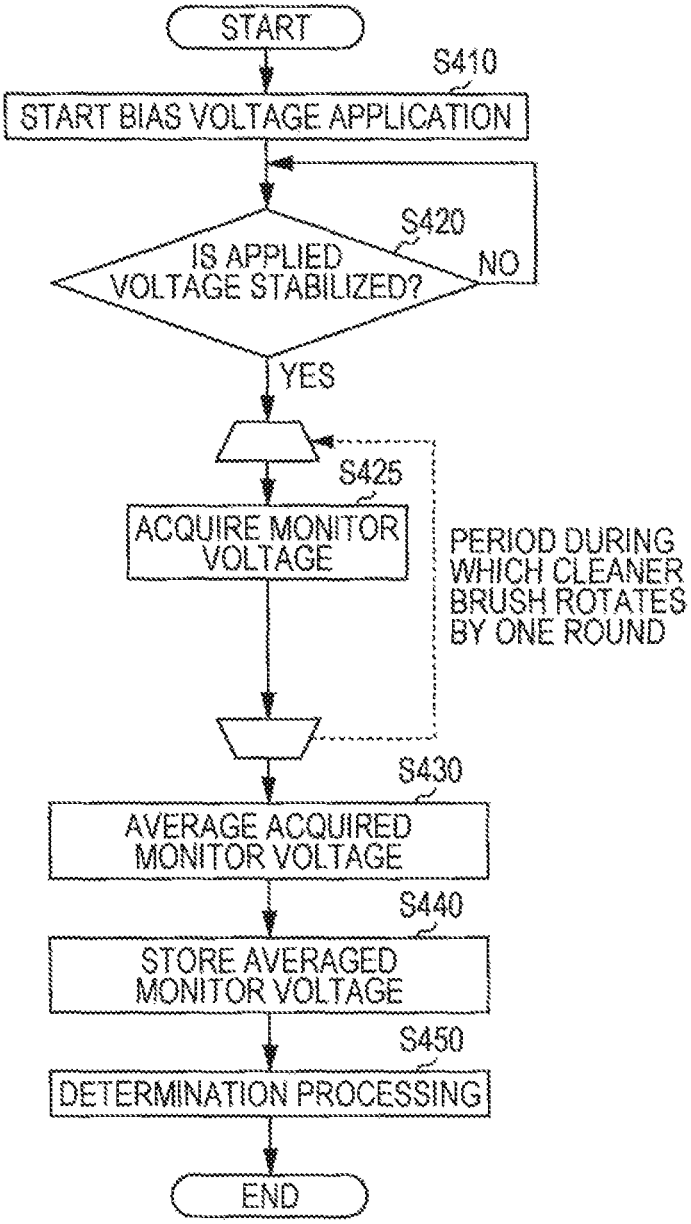
FIG. 4 is a flow diagram showing a processing procedure of life determination.

The life determination by the controller 101 according to an embodiment will be described with reference to FIGS. 4 and 5. FIG. 4 is a flow diagram showing a processing procedure of the life determination. This processing is realized, for example, by the CPU of the controller 101 executing a given program. FIG. 5 is a diagram showing threshold information 151 used in the life determination. In the flow diagram of FIG. 4, the life determination of the first cleaner brush 44 is described, but the life determination of the second cleaner brush 45 can also be realized in the same manner as the life determination of the first cleaner brush 44.

In step S410, the controller 101 starts applying the bias voltage to the first cleaner brush 44. Here, the polarity of the applied bias voltage is either plus or minus. The controller 101 switches the control to step S420.

In step S420, the controller 101 determines whether the applied voltage to the first cleaner brush 44 is stabilized on the basis of the amount of change per unit time of the applied voltage. For example, when the amount of change per unit time of the applied voltage becomes equal to or less than a predetermined threshold, the controller 101 determines that the applied voltage is stabilized. When determining that the applied voltage to the first cleaner brush 44 is stabilized (YES in step S420), the controller 101 switches the control to step S425. Otherwise (NO in step S420), the controller 101 performs the processing of step S420 again.

In step S425, the controller 101 acquires the monitor voltage due to the application of the bias voltage. Here, the first cleaner brush 44 is provided with a monitor circuit (not shown) for detecting the voltage at the time of application of the bias voltage. The controller 101 acquires the voltage information of the first cleaner brush 44 at the time of application of the bias voltage by acquiring the voltage detected by the monitor circuit. The controller 101 repeats step S425 until the monitor voltage of the period during which the first cleaner brush 44 rotates by one round can be acquired. The controller 101 switches the control to step S430.

In step S430, the controller 101 performs averaging processing of the acquired monitor voltage. The averaging processing means calculating the average value in the period of acquiring the voltage value (that is, the period during which the first cleaner brush 44 rotates by one round) with respect to the voltage value acquired in step S425. The controller 101 switches the control to step S440.

In step S440, the controller 101 stores the averaged monitor voltage in the storage device 120. The controller 101 switches the control to step S450.

In step S450, the controller 101 performs the life determination processing on the basis of the averaged monitor voltage. Specifically, the controller 101 compares the averaged monitor voltage with the threshold information 151 stored in the storage device 120. The threshold information 151 prescribes a voltage threshold for life determination for each absolute humidity. When the averaged monitor voltage calculated in step S430 exceeds the life threshold corresponding to humidity detected by a humidity sensor (not shown) of the image forming apparatus 100, the controller 101 determines that the life of the first cleaner brush 44 is ended. The controller 101 ends the processing.

[5. Bias Voltage Control Based on Determination Result of Life]

The bias voltage control based on the determination result of the life of the cleaner brush that has been described with reference to FIG. 4 will be described with reference to FIGS. 6A to 6D. FIGS. 6A to 6D are diagrams showing an overview of bias voltage control according to an embodiment. In FIGS. 6A to 6D and the subsequent drawings, the cleaner brush of which life is ended is displayed together with an "X" mark. That is, FIGS. 6A to 6D show an example in which the controller 101 determines that the life of the second cleaner brush 45 is ended.

Figure 6A:
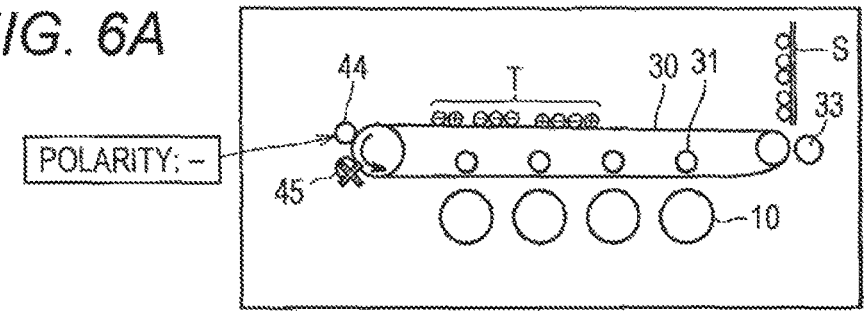
FIGS. 6A to 6D are diagrams showing an outline of bias voltage control.

As shown in FIG. 6A, after the toner image on the transfer belt 30 is transferred to a recording medium S, the toner T remains on the transfer belt 30. As described above, the toner T may include a toner having a plus charging polarity and a toner having a minus charging polarity. In FIG. 6A, the polarity of the bias voltage applied to the first cleaner brush 44 is minus. On the other hand, since the controller 101 has determined that the life of the second cleaner brush 45 is ended, no bias voltage is applied to the second cleaner brush 45. Here, since the transfer of the toner image to the recording medium S is completed, the photoreceptor 10 and the secondary transfer roller 33 are separated from the transfer belt 30.

Figure 6B:
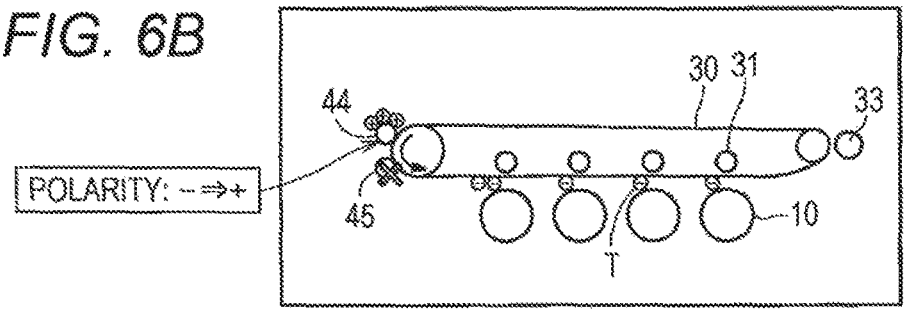

FIG. 6B shows a state in which the transfer belt 30 has been rotated in a direction of an arrow with respect to FIG. 6A. Among the toners T on the transfer belt 30, toners having a plus charging polarity are removed from the transfer belt 30 by electrostatic attraction from the first cleaner brush 44 to which a minus bias voltage is applied. On the other hand, among the toners T on the transfer belt 30, toners having the minus charging polarity move along with the rotation of the transfer belt 30 without being removed by the first cleaner brush 44 and the second cleaner brush 45. After the first cleaner brush 44 removes the toners having the plus charging polarity on the transfer belt 30, the controller 101 switches the polarity of the bias voltage to be applied to the first cleaner brush 44 from minus to plus.

Figure 6C:
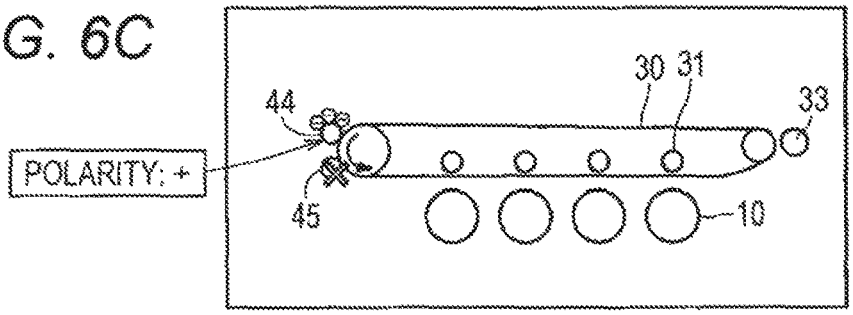
Figure 6D:
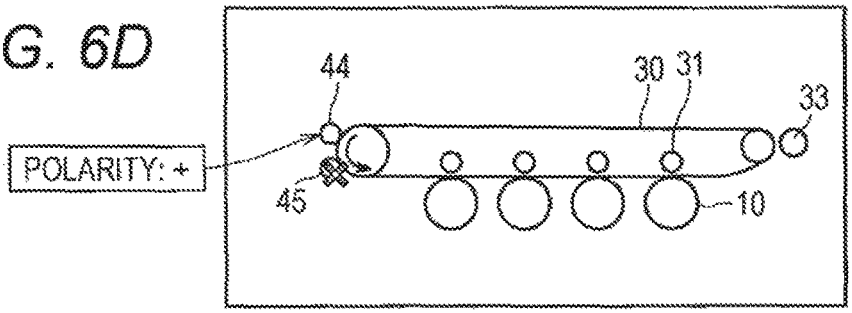

FIG. 6C shows a state in which the transfer belt 30 is rotated in a direction of an arrow with respect to FIG. 6B. In FIG. 6C, the toners T having a minus charging polarity are removed from the transfer belt 30 by electrostatic attraction from the first cleaner brush 44 to which a plus bias voltage is applied. Thereafter, as shown in FIG. 6D, the photoreceptor 10 and the secondary transfer roller 33 are displaced so as to contact with the transfer belt 30. As a result, preparation for the next image formation is completed.

The timing of the switching of the polarity of the applied voltage that has been described with reference to FIGS. 6A and 6B will be described with reference to FIGS. 7A to 7D. FIGS. 7A to 7D are diagrams for describing the timing of switching the polarity of the applied voltage according to an embodiment.

Figure 7A:
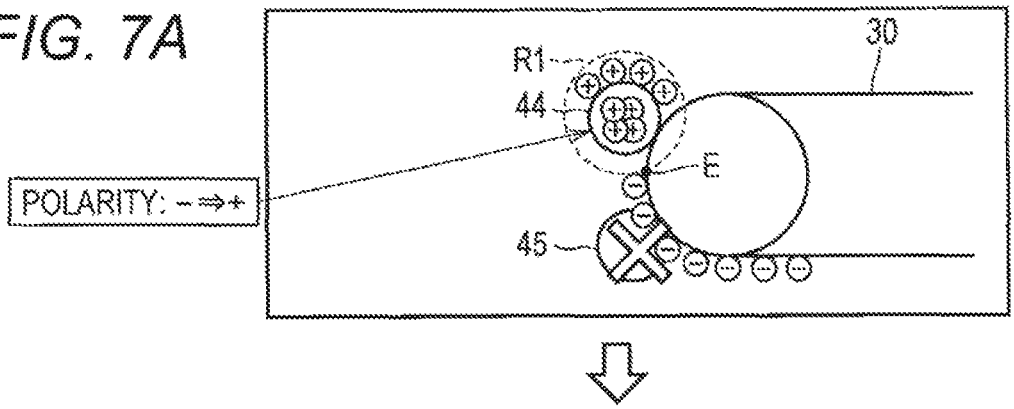
FIGS. 7A to 7D are diagrams showing timings at which a polarity of an applied voltage is switched.

FIG. 7A shows a region (hereinafter, referred to as a first removal region R1) where the toner on the transfer belt 30 can be removed from the transfer belt 30 by the first cleaner brush 44. The first removal region R1 is, for example, a region where the toner on the transfer belt 30 is affected by electrostatic attraction generated by the bias voltage applied to the first cleaner brush 44. An example of a timing at which the controller 101 switches the polarity of the bias voltage to be applied to the first cleaner brush 44 from minus to plus is, as shown in FIG. 7A, a time point at which a rear end E of the region where the toner image is formed passes through the first removal region R1. The reason for this will be described below.

Figure 7B:
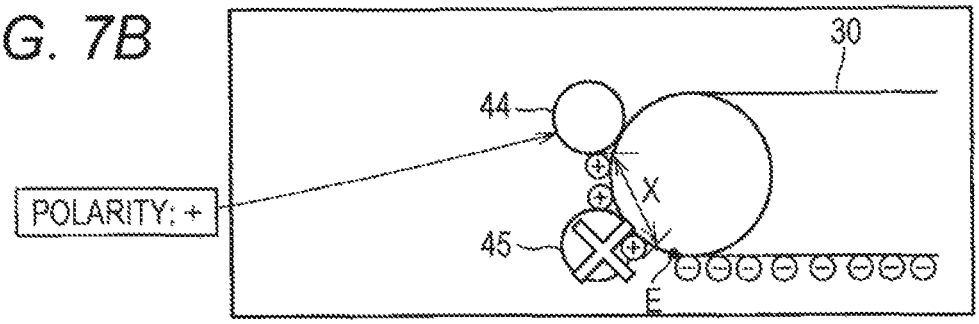

As shown in FIG. 7B, when the polarity of the bias voltage to be applied to the first cleaner brush 44 is switched from minus to plus, the toner removed from the transfer belt 30 before the polarity is switched (toner that is plus charged) is discharged from the first cleaner brush 44 to the transfer belt 30. Here, the region where the toner discharged from the first cleaner brush 44 onto the transfer belt 30 exists is shown as a region X.

Figure 7C:
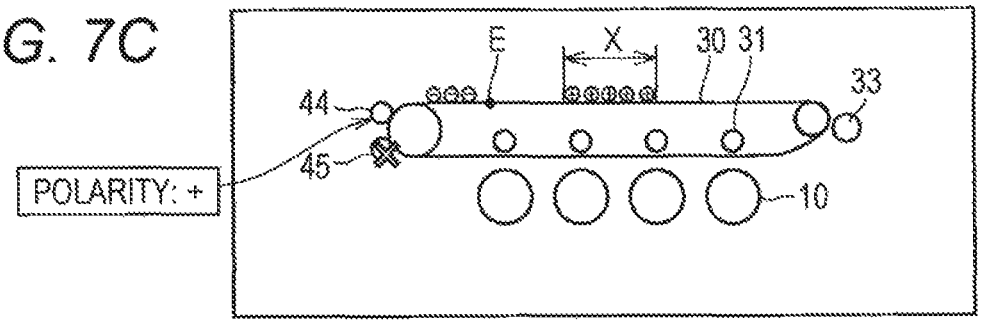

FIG. 7C shows a state in which the transfer belt 30 has been further rotated after the polarity of the bias voltage to be applied to the first cleaner brush 44 is switched to plus. In FIG. 7C, the minus-charged toner has moved to just before the first cleaner brush 44.

In FIG. 7C, as similar to FIG. 7B, the plus-charged toner discharged from the first cleaner brush 44 is located in the region X subsequent to the minus-charged toner, on the transfer belt 30. In order to remove the toner in the region X before the next image formation, it is necessary for the region X to pass through the first removal region R1 in a state where a minus bias voltage is applied again to the first cleaner brush 44. That is, in order to shorten the time until the next image formation, it is necessary for the region X to pass through the first removal region R1 as quickly as possible.

If the polarity switching of the bias voltage to be applied to the first cleaner brush 44 is delayed, the region X is separated from the rear end E on the transfer belt 30 as shown in FIG. 7C. This increases the time from when the rear end E passes through the first removal region R1 until the region X passes through the first removal region R1.

Figure 7D:
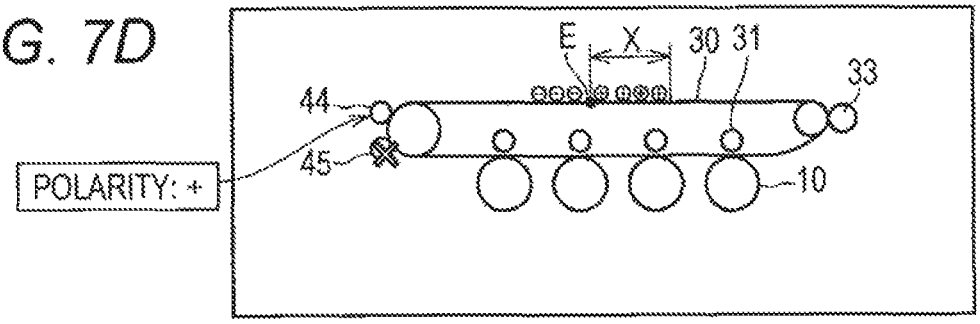

On the other hand, when the polarity of the bias voltage to be applied to the first cleaner brush 44 is switched when the rear end E passes through the first removal region R1 as shown in FIG. 7A, as shown in FIG. 7D, the region X is located just behind the rear end E and the time from when the rear end E passes through the first removal region R1 until the region X passes through the first removal region R1 becomes shorter. Therefore, the time until the next image formation is shorter. Therefore, as shown in FIG. 7A, it is preferable to switch the polarity of the bias voltage when the rear end E of the region where the toner image is formed passes through the first removal region R1.

[6. Processing Procedure]

Figure 8:
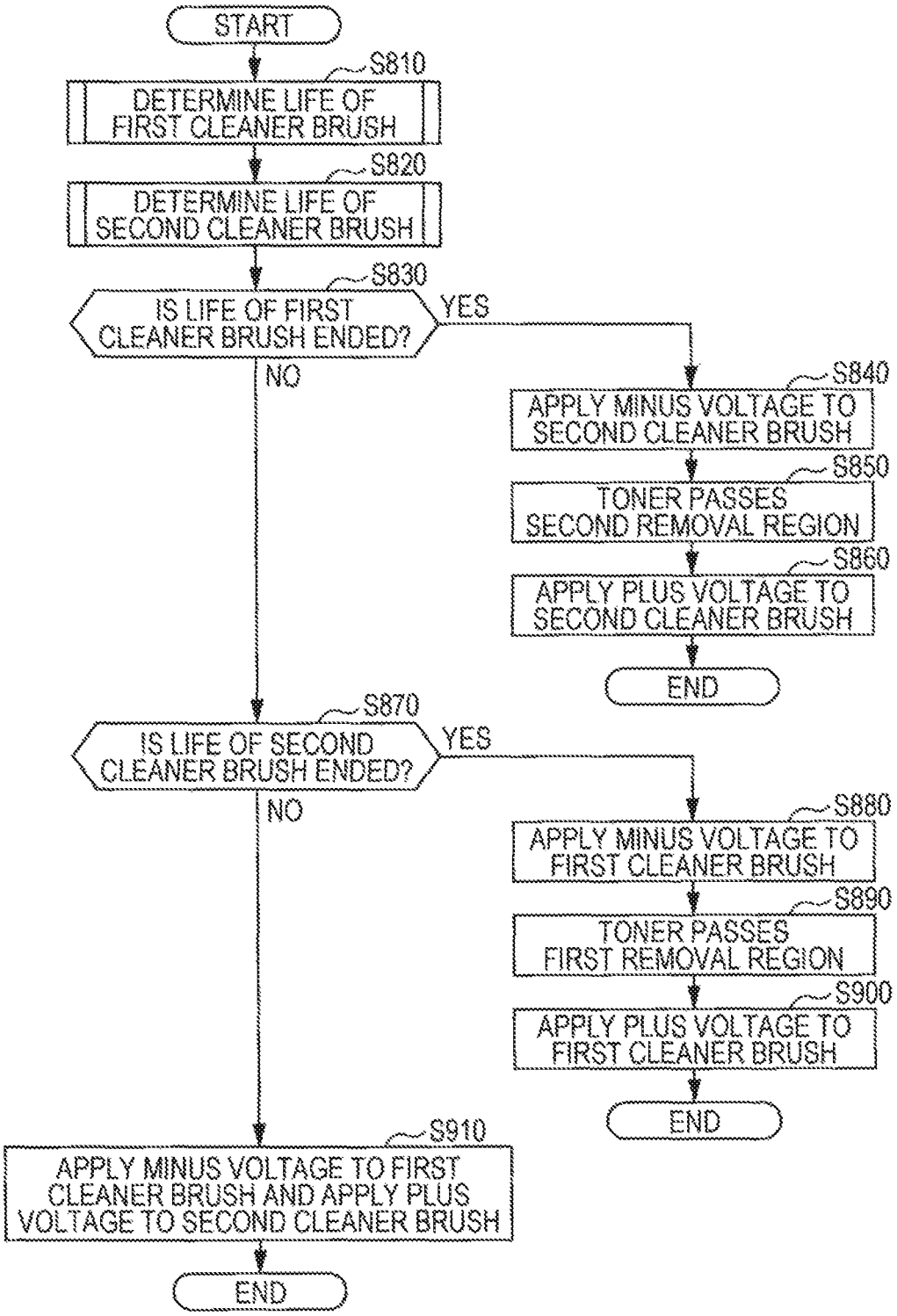
FIG. 8 is a flowchart showing a processing procedure of bias application control.

The processing procedure of bias application control according to an embodiment will be described with reference to FIG. 8. FIG. 8 is a flowchart showing a processing procedure of bias application control. This processing is realized, for example, by the CPU of the controller 101 executing a given program.

In step S810, the controller 101 performs the life determination processing (steps S410 to S450 in FIG. 4) of the first cleaner brush 44. The controller 101 switches the control to step S820.

In step S820, the controller 101 performs the life determination processing (steps S410 to S450 in FIG. 4) of the second cleaner brush 45. The controller 101 switches the control to step S830.

In step S830, the controller 101 switches the control on the basis of the determination result in step S810. That is, when the controller 101 determines that the life of the first cleaner brush 44 is ended (YES in step S830), the controller 101 switches the control to step S840. Otherwise (NO in step S830), the controller 101 switches the control to step S870.

In step S840, the controller 101 controls the bias application power supply 48 to apply a bias voltage of minus polarity to the second cleaner brush 45. The controller 101 switches the control to step S850.

In step S850, the controller 101 detects that the toner T has passed through a region (hereinafter referred to as a second removal region R2) where the toner T can be removed from the transfer belt 30 by the second cleaner brush 45. As similar to the first removal region R1 for the first cleaner brush 44, the second removal region R2 is, for example, a region affected by electrostatic attraction generated by the bias voltage applied to the second cleaner brush 45 by the toner on the transfer belt 30.

Here, the controller 101 detects that the toner T has passed through the second removal region R2 on the basis of the rotation speed of the transfer belt 30 and the region where the toner image is developed on the transfer belt 30. For example, the controller 101 specifies the timing at which the rear end (the rear end E in FIGS. 7A to 7D) of the region on which the toner image on the transfer belt 30 has been developed passes through the second removal region R2, and when detecting that the timing has come, the controller 101 detects that the toner T has passed through the second removal region R2. In another example, the controller 101 may detect that the toner T has passed through the second removal region R2 by using a well-known sensor such as a line sensor that detects passage of the toner T. The controller 101 switches the control to step S860.

In step S860, the controller 101 switches the polarity of the bias voltage to be applied to the second cleaner brush 45 and applies a voltage of plus polarity. After the toner T on the transfer belt 30 is removed, the controller 101 ends the processing.

In step S870, the controller 101 switches the control on the basis of the determination result in step S820. That is, when the controller 101 determines that the life of the first cleaner brush 44 is ended (YES in step S870), the controller 101 switches the control to step S880. Otherwise (NO in step S870), the controller 101 switches the control to step S910.

In step S880, the controller 101 controls the bias application power supply 48 to apply a bias voltage of minus polarity to the first cleaner brush 44. The controller 101 switches the control to step S890.

In step S890, the controller 101 detects that the toner T has passed through the first removal region R1 by the first cleaner brush 44. The controller 101 switches the control to step S900.

In step S900, the controller 101 switches the polarity of the bias voltage to be applied to the first cleaner brush 44 and applies a voltage of plus polarity. After the toner T on the transfer belt 30 is removed, the controller 101 ends the processing.

On the other hand, in step S910, the controller 101 applies a bias voltage of minus polarity to the first cleaner brush 44 and a bias voltage of plus polarity to the second cleaner brush 45. After the toner T on the transfer belt 30 is removed, the controller 101 ends the processing.

As described above, the image forming apparatus 100 according to the present embodiment determines the life of each of the first cleaner brush 44 and the second cleaner brush 45 of the cleaning unit 43. Thus, since it is possible to grasp that the life of each cleaner brush is ended, the burden of maintenance can be reduced. When determining that either one of the life is ended, the controller 101 switches the voltage to be applied to the other so that the toner T on the transfer belt 30 is removed In this way, the life of the cleaning unit 43 can be extended.

Second Embodiment

[Overview]

A second embodiment is different from the first embodiment in that a the cleaner brush of which life has been determined to be ended is applied with a voltage of the same polarity as or opposite polarity from the voltage applied to the cleaner brush of which the life has not been determined to be ended. The image forming apparatus according to the present embodiment is realized by the same configuration as that of the image forming apparatus 100 according to the above-described embodiment. Therefore, description of these configurations will not be repeated.

[Details]

Figure 9A:
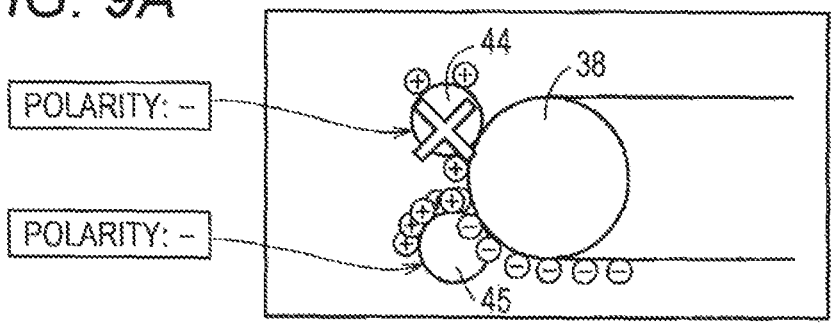
FIGS. 9A to 9C are diagrams showing an example of applying a bias voltage of the same polarity to one cleaner brush of which life has been determined to be ended, and another cleaner brush.
Figure 9B:
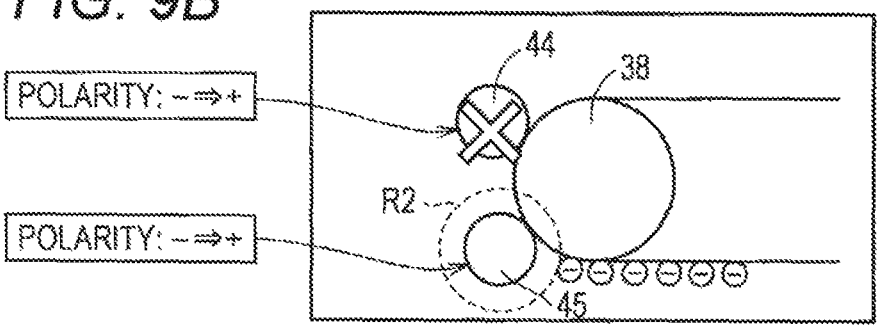
Figure 9C:
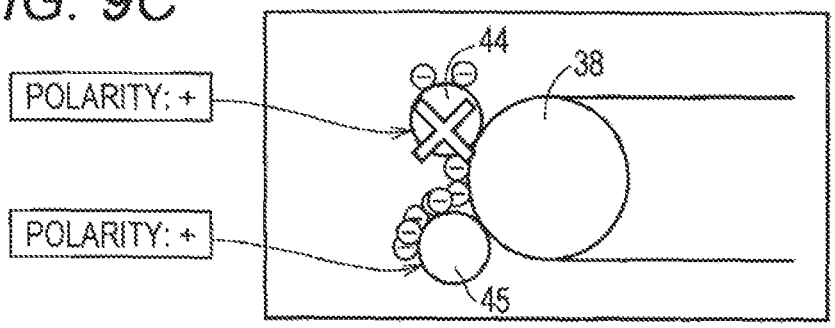

The bias voltage control according to the second embodiment will be described with reference to FIGS. 9A to 10G. FIGS. 9A to 9C are diagrams showing an example of applying a bias voltage of the same polarity to one cleaner brush of which life has been determined to be ended, and the other cleaner brush. FIGS. 10A to 10G are diagrams showing an example of applying a bias voltage of the opposite polarities to one cleaner brush of which life has been determined to be ended, and the other cleaner brush.

As shown in FIG. 9A, in the second embodiment, when the controller 101 determines that the life of the first cleaner brush 44 is ended, the controller 101 applies a bias voltage of minus polarity to the first cleaner brush 44 and the second cleaner brush 45. As a result, the toner T having the plus charging polarity is removed from the transfer belt 30 by the second cleaner brush 45. A part of the toner T is removed from the transfer belt 30 by the first cleaner brush 44.

As shown in FIG. 9B, when the toner T having the minus charging polarity passes through the second removal region R2, the controller 101 controls the bias application power supply 48 to switch the polarity of the bias voltage to be applied to the first cleaner brush 44 and the second cleaner brush 45 to plus.

As a result, as shown in FIG. 9C, as the transfer belt 30 rotates, the toner T having a minus charging polarity remaining on the transfer belt 30 is removed in the first cleaner brush 44 and the second cleaner brush 45. As a result, removal of the toner T on the transfer belt 30 is completed.

Figure 10A:
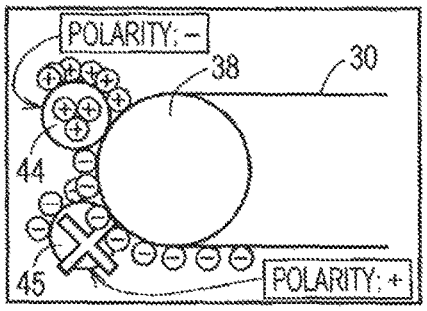
FIGS. 10A to 10G are diagrams showing an example of applying a bias voltage of the opposite polarities to one cleaner brush of which life has been determined to be ended, and another cleaner brush.

On the other hand, as shown in FIG. 10A, when the controller 101 determines that the life of the second cleaner brush 45 is ended, the controller 101 controls the bias application power supply 48 to apply a bias voltage of minus polarity to the first cleaner brush 44, a bias voltage of plus polarity to the second cleaner brush 45. As a result, the toner T having the plus charging polarity is removed from the transfer belt 30 by the first cleaner brush 44. On the other hand, a part of the toner T having the minus charging polarity is removed by the second cleaner brush 45, and the remaining toner T moves on the transfer belt 30.

Figure 10B:
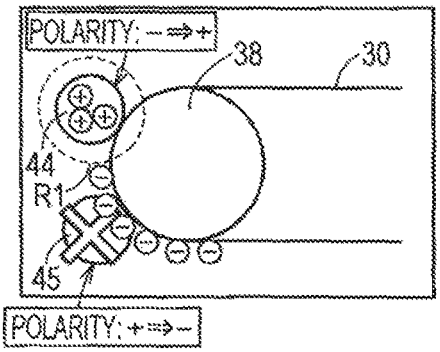

As shown in FIG. 10B, when the toner T having the minus charging polarity passes through the first removal region R1, the controller 101 switches the polarity of a bias voltage applied to the first cleaner brush 44 and the second cleaner brush 45. That is, the controller 101 controls the bias application power supply 48 so as to apply a bias voltage of plus polarity to the first cleaner brush 44 and a bias voltage of minus polarity to the second cleaner brush 45.

Figure 10C:
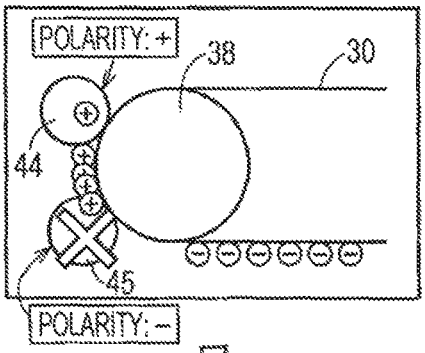

As shown in FIG. 10C, the polarity of the bias voltage to be applied to the first cleaner brush 44 is switched from minus to plus, so that the toner T having the plus charging polarity accumulated inside the first cleaner brush 44 is discharged to the transfer belt 30.

Figure 10D:
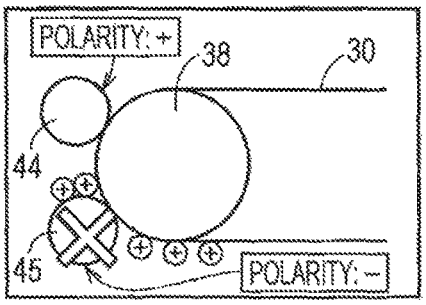

As shown in FIG. 10D, a part of the toner T having the plus charging polarity that has been discharged from the first cleaner brush 44 is removed from the transfer belt 30 by the second cleaner brush 45.

Figure 10E:
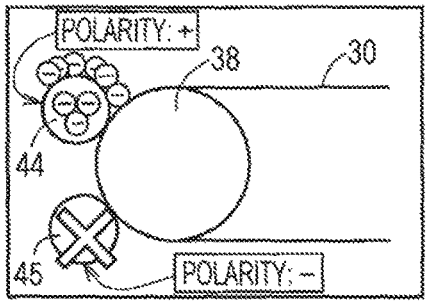

As shown in FIG. 10E, the toner T having the minus charging polarity reaches the first removal region R1 along with the rotation of transfer belt 30, and is removed by the first cleaner brush 44.

Figure 10F:
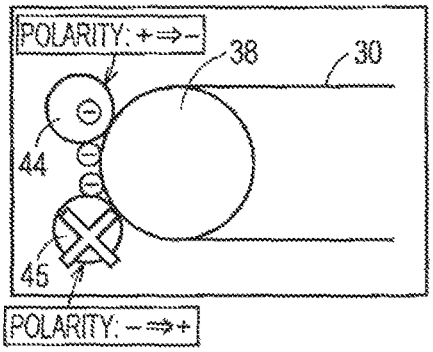

As shown in FIG. 10F, the controller 101 switches the bias voltage to be applied to the first cleaner brush 44 from plus to minus, and switches the bias voltage to be applied to the second cleaner brush 45 from minus to plus. As a result, the toner T having the minus charging polarity accumulated inside the first cleaner brush 44 is discharged.

Figure 10G:
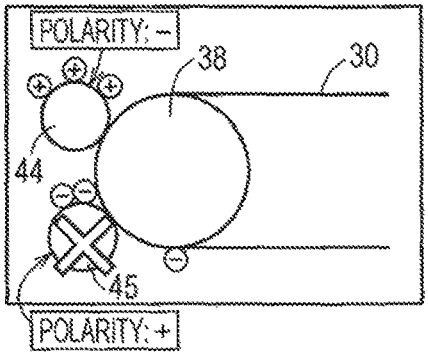

As shown in FIG. 10G, a part of the toner T having the minus charging polarity that has been discharged from the inside of the first cleaner brush 44 is removed from the transfer belt 30 by the second cleaner brush 45 in the second removal region R2. In FIG. 10C, the toner T having the plus charging polarity that has been discharged from the inside of the first cleaner brush 44 is removed from the transfer belt 30 by the electrostatic attraction force of the first cleaner brush 44. In this manner, the toner on the transfer belt 30 is removed.

Figure 11:
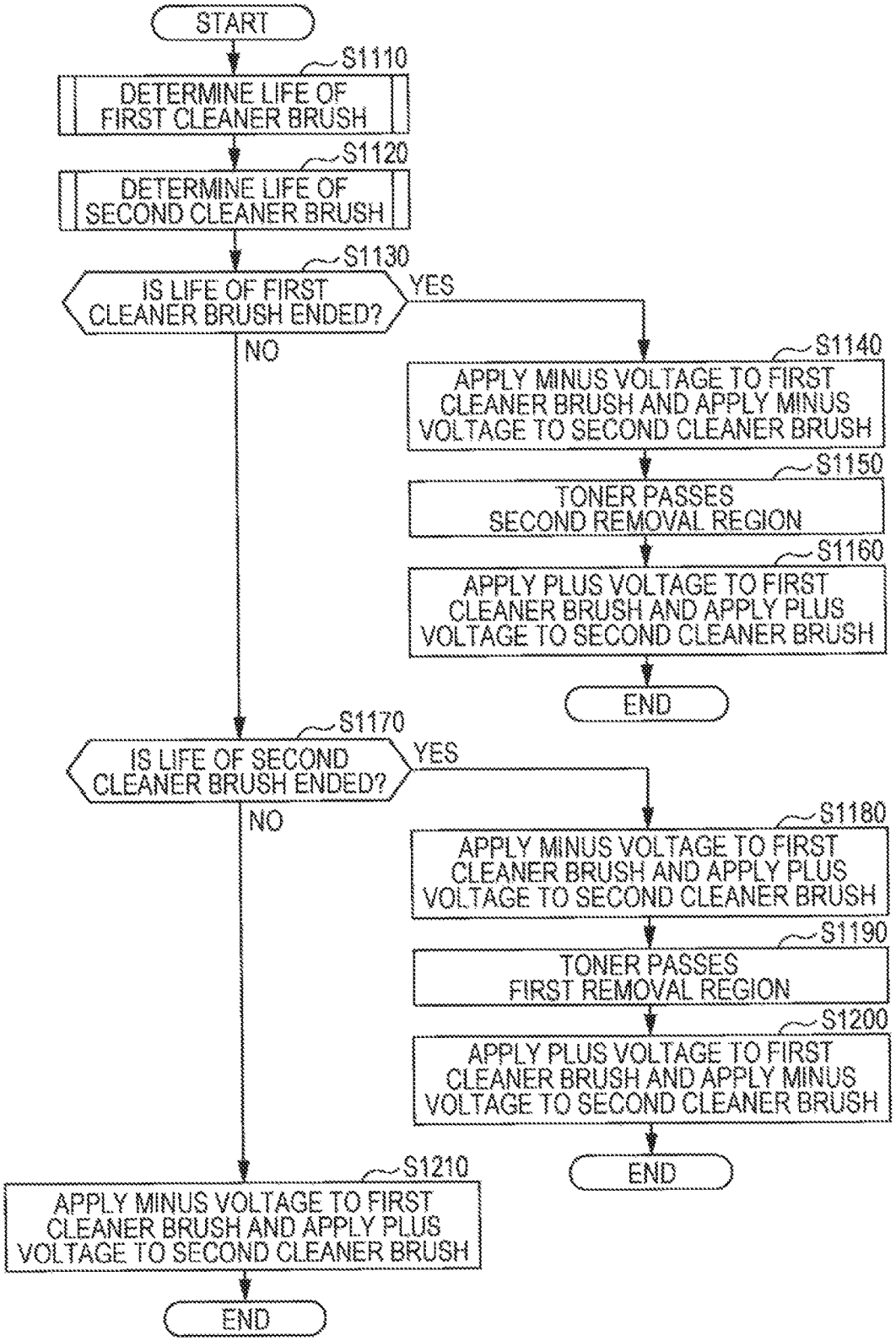
FIG. 11 is a flowchart showing a processing procedure of bias application control in a second embodiment.

The processing procedure of the bias application control in the second embodiment will be described with reference to FIG. 11. FIG. 11 is a flowchart showing the processing procedure of the bias application control in the second embodiment. This processing is realized, for example, by the CPU of the controller 101 executing a given program.

Since the processing in step S1110 to step S1130 is similar to the processing in step S810 to step S830 in FIG. 8, the description of the processing will not be repeated. In step S1140, the controller 101 controls the bias application power supply 48 to apply a bias voltage of minus polarity to each of the first cleaner brush 44 and the second cleaner brush 45. The controller 101 switches the control to step S1150. Since the processing in step S1150 is similar to the processing in step S850, the description of the processing will not be repeated.

In step S1160, the controller 101 switches the polarity of the bias voltage to be applied to the first cleaner brush 44 and the second cleaner brush 45, and applies a voltage of plus polarity. After the toner T on the transfer belt 30 is removed, the controller 101 ends the processing.

Since the processing in step S1170 is similar to the processing in step S870, the description will not be repeated. In step S1180, the controller 101 controls the bias application power supply 48 to apply a bias voltage of minus polarity to the first cleaner brush 44 and a voltage of plus polarity to the second cleaner brush 45. The controller 101 switches the control to step S1190. Since the processing in step S1190 is similar to the processing in step S890, the description will not be repeated.

In step S1200, the controller 101 switches the polarity of the bias voltage to be applied to the first cleaner brush 44 and the second cleaner brush 45. That is, the controller 101 controls the bias application power supply 48 so as to apply a voltage of plus polarity to the first cleaner brush 44 and a voltage of minus polarity to the second cleaner brush 45. After the toner T on the transfer belt 30 is removed, the controller 101 ends the processing.

As described above, in the image forming apparatus 100 according to the second embodiment, when it is determined that the life of either one of the first cleaner brush 44 and the second cleaner brush 45 is ended, a cleaner brush of which life has been determined to be ended is applied with a voltage of the same polarity as or opposite polarity from the voltage applied to the cleaner brush of which life has not been determined to be ended. Thereby, the toner T on the transfer belt 30 can be more effectively removed.

Third Embodiment

[Overview]

A third embodiment is different from the first embodiment in that, when the controller 101 determines that the life of both the first cleaner brush 44 and the second cleaner brush 45 is ended, the image forming part 90 performs image formation only for a single color image. The image forming apparatus according to the present embodiment is realized by the same configuration as that of the image forming apparatus 100 according to the above-described embodiment. Therefore, description of these configurations will not be repeated.

Figure 12A:
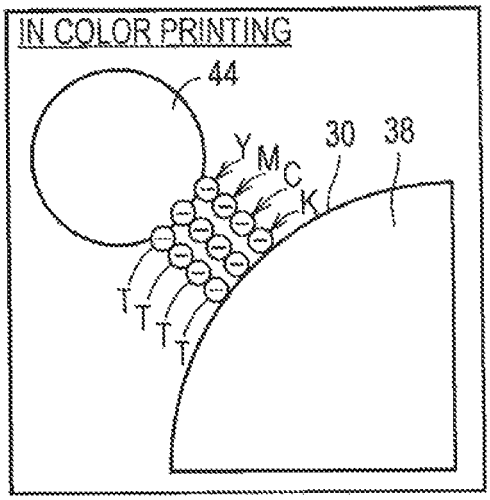
FIGS. 12A and 12B are schematic diagrams of a toner on a transfer belt.
Figure 12B:
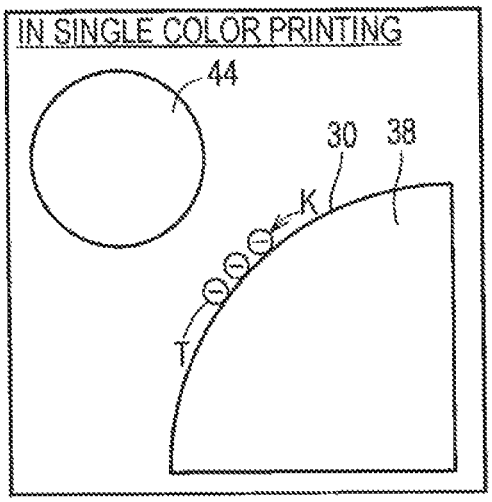

With reference to FIGS. 12A and 12B, the principle of restriction of a formed image according to the third embodiment will be described. FIGS. 12A and 12B are schematic diagrams of the toner T on the transfer belt 30.

As shown in FIG. 12A, when a color image is printed, the toners T of yellow (Y), magenta (M), cyan (C), and black (K) are layered and remained on the transfer belt 30. On the other hand, as shown in FIG. 12B, in a case of a single color image, only the toner T of black (K) remains on the transfer belt 30. Therefore, as compared with the toner T at the time of color image printing, the toner T at the time of single color image printing is easy to be removed.

In the life determination processing, the controller 101 determines whether the toner T at the time of color image formation can be removed, for the first cleaner brush 44 and the second cleaner brush 45 of which life has been determined to be ended. Therefore, even with the cleaner brush of which life has been determined to be ended in the life determination processing, the toner T of a single color image can be removed.

Figure 13:
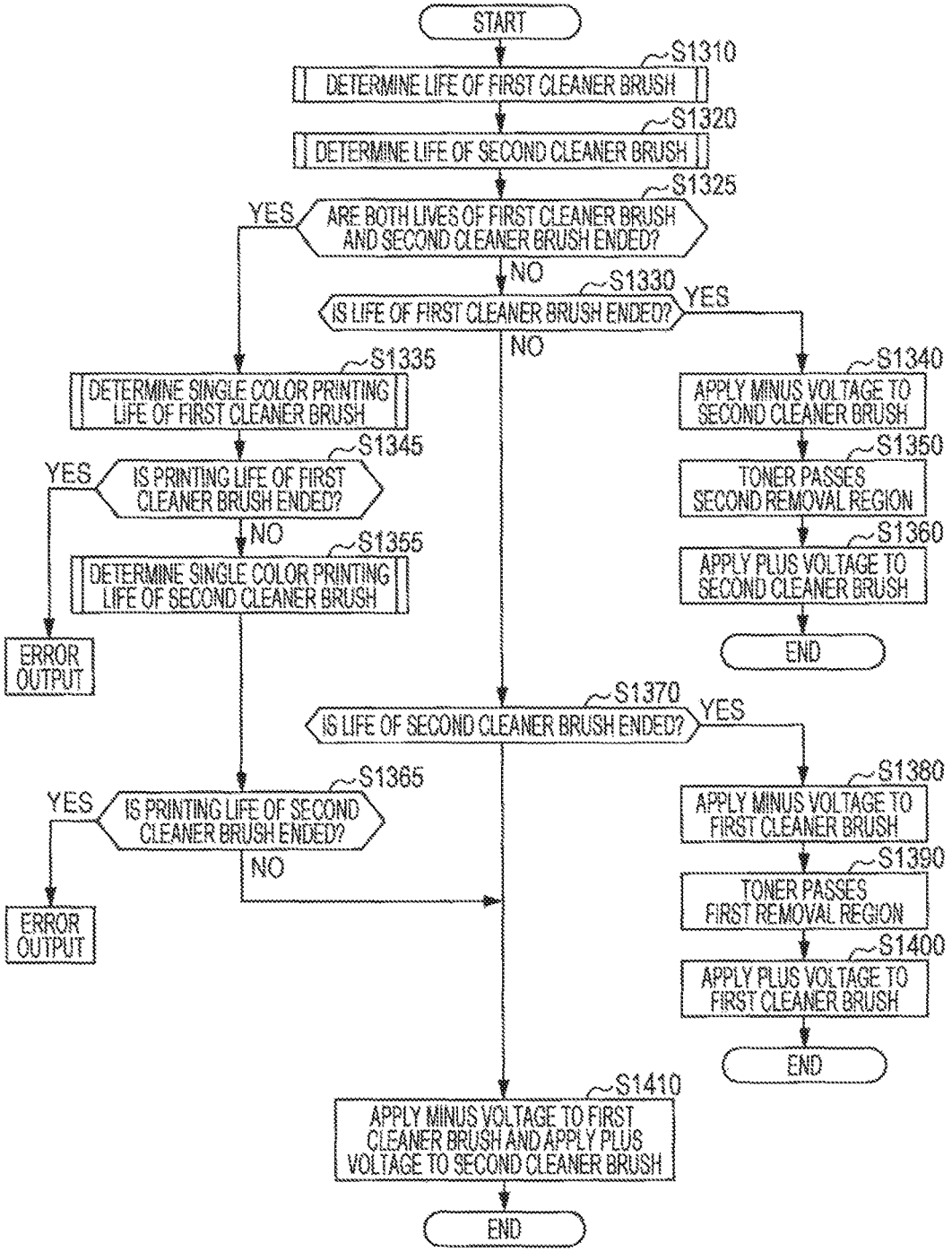
FIG. 13 is a flowchart showing a processing procedure of bias application control according to a third embodiment.

The processing procedure of the single color printing life determination according to the third embodiment will be described with reference to FIG. 13. FIG. 13 is a flowchart showing the processing procedure of bias application control according to the third embodiment. This processing is realized, for example, by the CPU of the controller 101 executing a given program.

Since the processing in step S1310 and step S1320 is similar to the processing in step S810 and step S820 in FIG. 8, the description of the processing will not be repeated. After step S820, the controller 101 switches the control to step S1325.

In step S1325, the controller 101 determines whether the life of both of the first cleaner brush 44 and the second cleaner brush 45 is ended on the basis of the processing results in steps S1310 and S1320. When determining that the life of both of them is ended, (YES in step S1325), the controller 101 switches the control to step S1335. Otherwise (NO in step S1325), the controller 101 switches the control to step S1330. Since the processing of steps S1330 to S1410 is similar to the processing of steps S830 to S910 in FIG. 8, the description of the processing will not be repeated.

In step S1335, the controller 101 determines whether the life of the first cleaner brush 44 for printing a single color image is ended. Specifically, determination processing is performed using the threshold information 251 shown in FIG. 14. FIG. 14 is a diagram showing threshold information used in print life determination of a single color image.

As shown in FIG. 14, in the threshold information 251, a single-color printing life threshold is set as a voltage value higher than the normal life threshold. The controller 101 compares the averaged monitor voltage (see step S440 in FIG. 4) acquired in step S1310 with threshold information 251 and determines whether or not the life of single color printing has arrived at the first cleaner brush 44 judge. The controller 101 switches the control to step S1345.

In step S1345, the controller 101 switches the control on the basis of the determination result in step S1335. That is, when determining that the single color printing life of the first cleaner brush 44 is ended (YES in step S1345), the controller 101 outputs an error to the operation panel 105 and ends the process. Otherwise (NO in step S1345), the controller 101 switches the control to step S1355.

In step S1355, the controller 101 determines whether the life of the second cleaner brush 45 for printing a single color image is ended. The controller 101 switches the control to step S1365.

In step S1365, the controller 101 switches the control based on the determination result in step S1355. That is, when determining that the single color printing life of the second cleaner brush 45 is ended (YES in step S1365), the controller 101 outputs an error to the operation panel 105 and ends the processing. Otherwise (NO in step S1365), the controller 101 switches the control to step S1410.

As described above, in the image forming apparatus 100 according to the third embodiment, when determining that the life of both of the first cleaner brush 44 and the second cleaner brush 45 is ended, the controller 101 controls the image forming part 90 so as to perform image formation of only a single color image. Thereby, the life of the cleaning unit 43 can be extended further.

Fourth Embodiment

[Overview]

A fourth embodiment is different from the first embodiment in that, when it is determined that the life of either one of the first cleaner brush 44 or the second cleaner brush 45 is ended, the number of application times of the bias voltage to be applied to the other is further determined. The image forming apparatus according to the present embodiment is realized by the same configuration as that of the image forming apparatus 100 according to the above-described embodiment. Therefore, description of these configurations will not be repeated.

Figure 15:
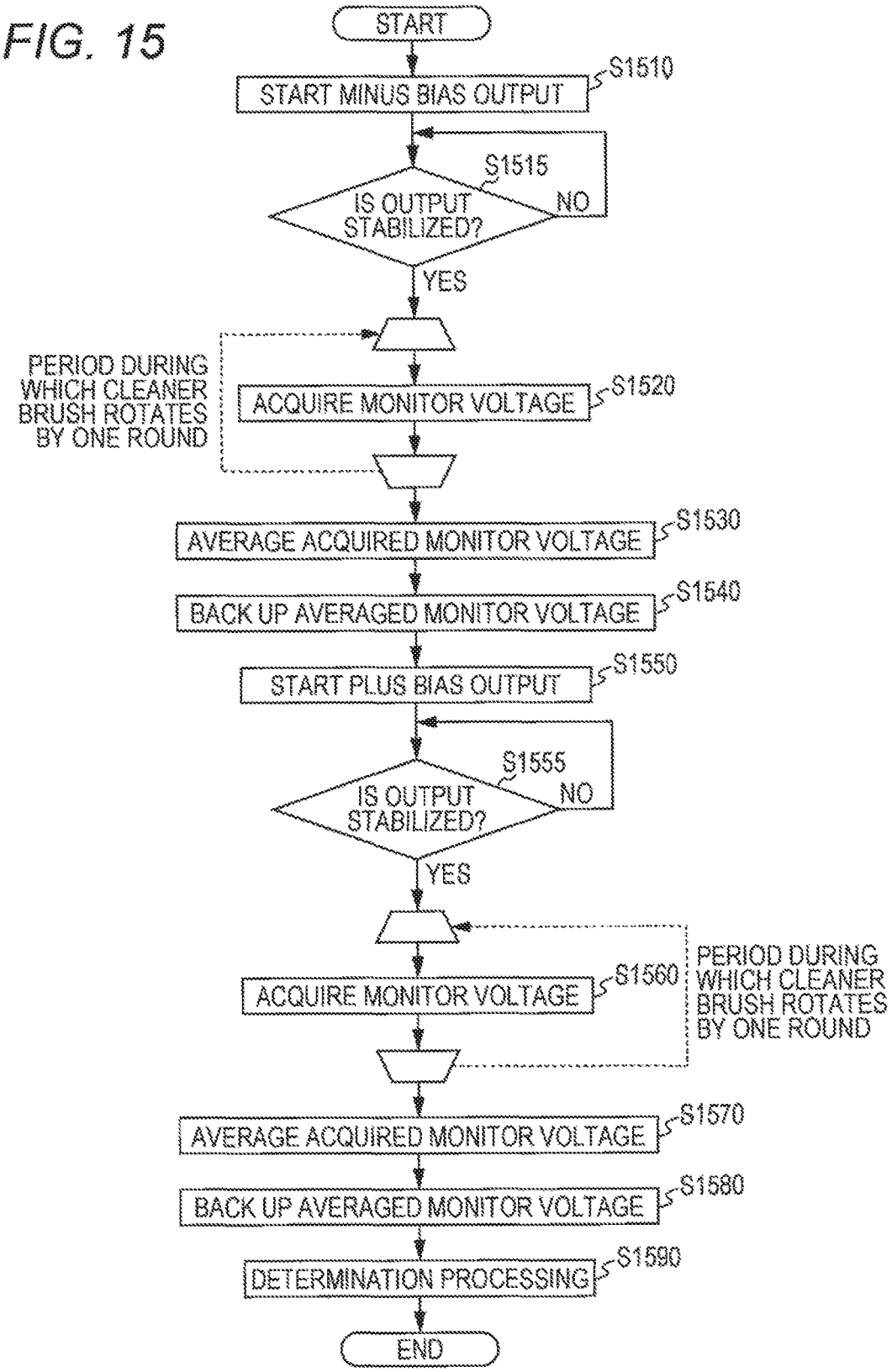
FIG. 15 is a flow diagram showing a processing procedure of life determination according to a fourth embodiment.
Figure 16:
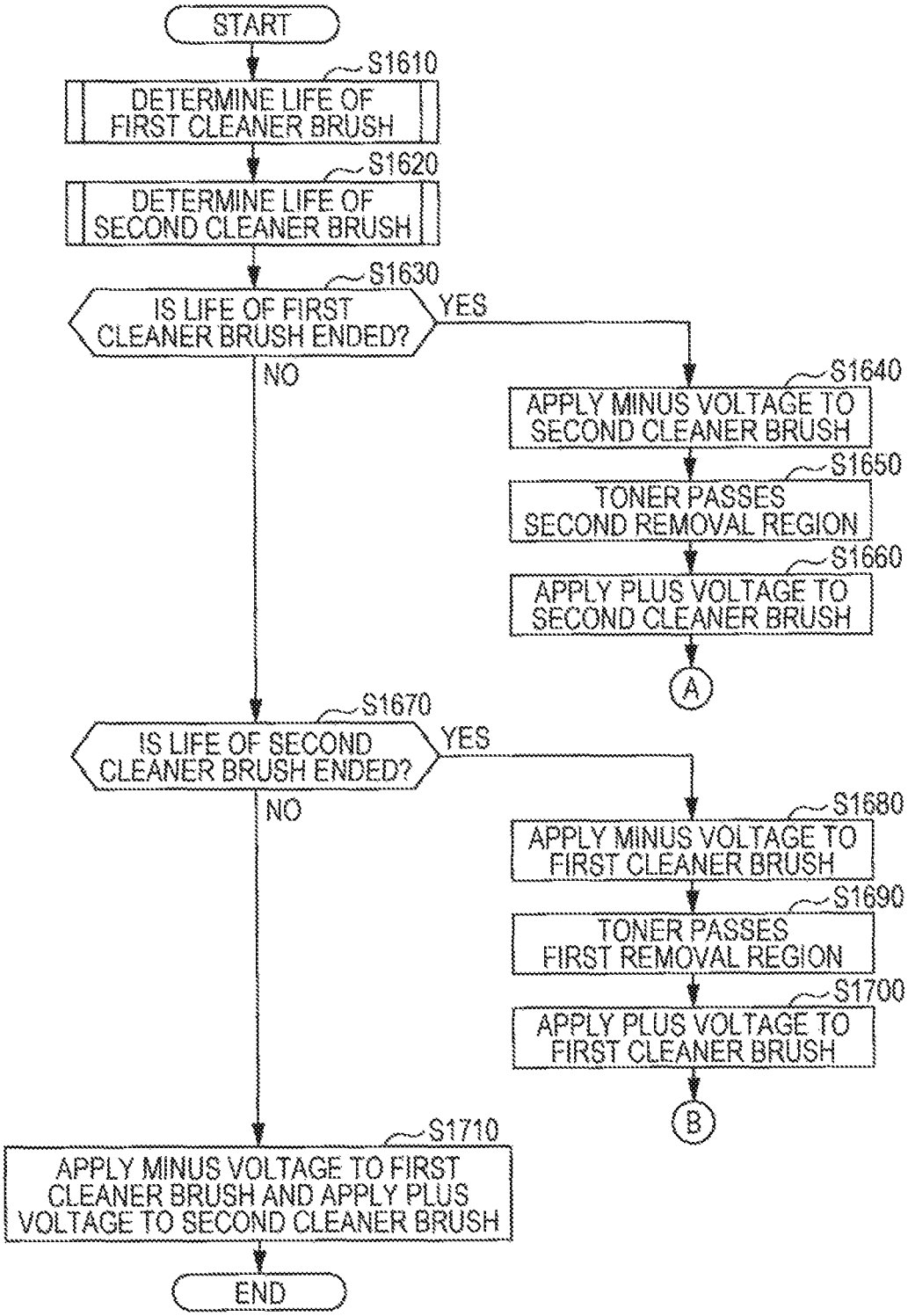
FIG. 16 is a flowchart showing a processing procedure of control of the number of times of bias application.
Figure 17:
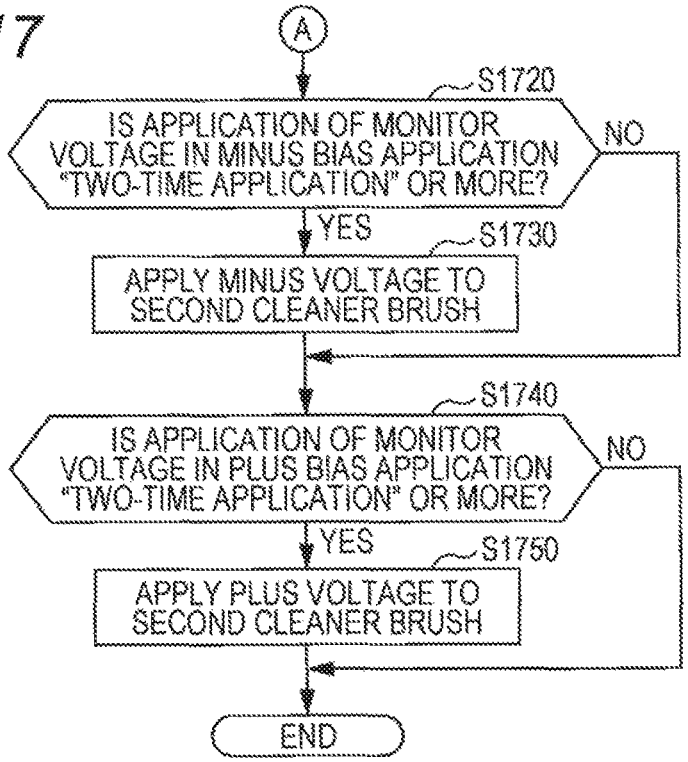
FIG. 17 is a flowchart showing a processing procedure of control of the number of times of bias application.
Figure 18:
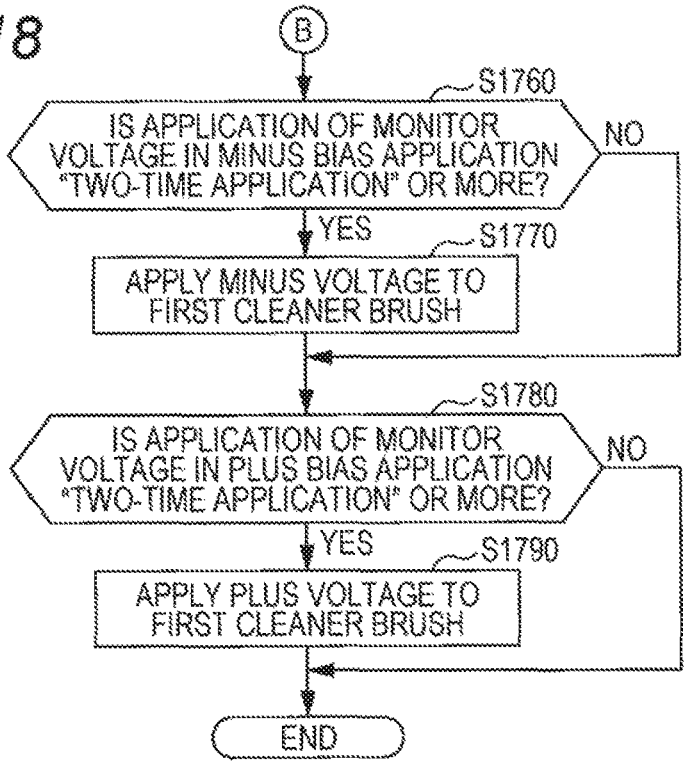
FIG. 18 is a flowchart showing a processing procedure of control of the number of times of bias application.

The processing procedure for determining the number of bias application times will be described with reference to FIG. 15 to FIG. 18. FIG. 15 is a flow diagram showing the processing procedure of life determination according to the fourth embodiment. FIGS. 16 to 18 are flowcharts showing the processing procedure for determining the number of bias application times. These processes are realized, for example, by the CPU of the controller 101 executing a given program.

As shown in FIG. 15, in the life determination processing in the fourth embodiment, the controller 101 applies a minus voltage and a plus voltage to one cleaner brush to measure a monitor voltage. That is, steps S1510 to S1540 and steps S1550 to S1580 are the same as steps S410 to S440 that has been described in FIG. 4. Therefore, description of these will not be repeated. The controller 101 switches the control to step S1590.

In step S1590, the controller 101 compares the averaged monitor voltage (acquired in step S1540) acquired by applying a bias voltage of minus polarity and the averaged monitor voltage (acquired in step S1580) acquired by applying a bias voltage of plus polarity, and determines the life by using the one of the monitor voltages that has the larger absolute value and the threshold information 351 shown in FIG. 19.

FIG. 19 shows the threshold information 351 used in the fourth embodiment. As shown in FIG. 19, the threshold information 351 includes a "two-time application threshold" in addition to the "normal life" threshold. In step S1590, the "normal life" threshold is used. "Two-time application threshold" is used in steps S1720, 1740, 1760, 1780 described later. After performing the processing of step S1590, the controller 101 ends the life determination processing.

The processing procedure for determining the number of bias application times will be described with reference to FIG. 16. In step S1610, the controller 101 performs the above-described life determination processing (steps S1510 to S1590) on the first cleaner brush 44. The controller 101 switches the control to step S1620.

In step S1620, the controller 101 performs the above-described life determination processing (steps S1510 to S1590) on the second cleaner brush 45. The controller 101 switches the control to step S1630.

Since the processing of steps S1630 to S1710 is similar to the processing of steps S830 to S910 in FIG. 8, the description of the processing will not be repeated. After step S1660, the controller 101 switches the control to step S1720 (FIG. 17).

In step S1720, the controller 101 compares the averaged monitor voltage value (acquired in step S1540) averaged at the time of minus bias application and the two-time application threshold of the threshold information 351 with respect to the second cleaner brush 45. The two-time application threshold (FIG. 19) is a threshold for determination on whether the state of the cleaner brush is a state in which the bias voltage needs to be applied two times so that the toner T is removed from the transfer belt 30. When determining that the monitor voltage value is two-time application threshold or more (YES in step S1720), the controller 101 switches the control to step S1730. Otherwise (NO in step S1720), the controller 101 switches the control to step S1740.

In step S1730, the controller 101 applies a bias voltage of minus polarity to the second cleaner brush 45. The controller 101 switches the control to step S1740.

In step S1740, the controller 101 compares the averaged monitor voltage value (acquired in step S1580) at the time of the plus bias application and the two-time application threshold of the threshold information 351, with respect to the second cleaner brush 45. When the monitor voltage value is the two-time application threshold or more (YES in step S1740), the controller 101 switches the control to step S1750. Otherwise (NO in step S1740), the controller 101 ends the processing.

In step S1750, the controller 101 applies a bias voltage of plus polarity to the second cleaner brush 45. The controller 101 ends the processing.

On the other hand, after step S1700, the controller 101 switches the control to step S1760 (FIG. 18). In step S1760, the controller 101 compares the averaged monitor voltage value (acquired in step S1540) at the time of minus bias application and the two-time application threshold (FIG. 19) of the threshold information 351, with respect to the first cleaner brush 44. When determining that the monitor voltage value is two-time application threshold or more (YES in step S1760), the controller 101 switches the control to step S1770. Otherwise (NO in step S1760), the controller 101 switches the control to step S1780.

In step S1770, the controller 101 applies a bias voltage of minus polarity to the first cleaner brush 44. The controller 101 switches the control to step S1780.

In step S1780, the controller 101 compares the averaged monitor voltage value (acquired in step S1580) at the time of the plus bias application and the two-time application threshold of the threshold information 351, with respect to the first cleaner brush 44. When determining that the monitor voltage value is two-time application threshold or more (YES in step S1780), the controller 101 switches the control to step S1790. Otherwise (NO in step S1780), the controller 101 ends the processing.

In step S1790, the controller 101 applies a bias voltage of plus polarity to the first cleaner brush 44. The controller 101 ends the processing.

As described above, in the image forming apparatus 100 according to the fourth embodiment, when it is determined that the life of either one of the first cleaner brush 44 or the second cleaner brush 45 is ended, the controller 101 determines the number of switching times of the applied voltage on the other of the first cleaner brush 44 or the second cleaner brush 45, and switches the applied voltage for the number of times in accordance with the determination result. In this way, the toner T on the transfer belt 30 can be removed more reliably.

Other Embodiments

The scope of application of the technical idea pertaining to the present disclosure is not limited to each of the embodiments described above. For example, the controller 101 may determine whether the life is ended with respect to either one of the first cleaner brush 44 and the second cleaner brush 45, and when it is determined that the one of the brushes has been ended, the controller switches a bias voltage between the same polarity as and the opposite polarity from the toner and apply the bias voltage to the other one of which the life has not been determined to be ended. Even in this case, the same effect as the above embodiments can be obtained.

Although embodiments of the present invention have been described and illustrated in detail, the disclosed embodiments are made for purposes of illustration and example only and not limitation. The scope of the present invention should be interpreted by terms of the appended claims, and it is intended that all modifications within meaning and scope equivalent to the claims are included.

What is claimed is:

1. An image forming apparatus comprising:

an image carrier that carries a toner image;

a cleaning unit that collects a toner on the image carrier; and a hardware processor that controls the cleaning unit, wherein the cleaning unit includes a first cleaner brush and a second cleaner brush that remove the toner from the image carrier, and the hardware processor is configured to:

apply bias voltages having opposite polarities to the first cleaner brush and the second cleaner brush, determine whether life is ended with respect to each of the first cleaner brush and the second cleaner brush, when it is determined that life has not ended for one of the first cleaner brush and the second cleaner brush but has ended for another of the first cleaner brush and the second cleaner brush, operate the one cleaner brush at a first polarity while a region of the image carrier where a toner image is formed passes by the one cleaner brush, and when a trailing end of the region has passed the one cleaner brush, change the polarity of the one cleaner brush.

2. The image forming apparatus according to claim 1, wherein the hardware processor determines whether the life of the first cleaner brush is ended on the basis of voltage information or current information of the first cleaner brush when the bias voltage is applied to the first cleaner brush, and determines whether the life of the second cleaner brush is ended on the basis of voltage information or current information of the second cleaner brush when the bias voltage is applied to the second cleaner brush.

3. The image forming apparatus according to claim 1, wherein the hardware processor determines polarities of bias voltages to be applied to the first cleaner brush and the second cleaner brush on the basis of a result of the determination.

4. The image forming apparatus according to claim 1, wherein the hardware processor applies bias voltages having opposite polarities to the first cleaner brush and the second cleaner brush when it is determined that the life of both of the first cleaner brush and the second cleaner brush is not ended.

5. An image forming apparatus comprising:

an image carrier that carries a toner image;

a cleaning unit that collects a toner on the image carrier; and a hardware processor that controls the cleaning unit, wherein the cleaning unit includes a first cleaner brush and a second cleaner brush that remove the toner from the image carrier, and the hardware processor is configured to:

apply bias voltages having opposite polarities to the first cleaner brush and the second cleaner brush, and determine whether life is ended with respect to each of the first cleaner brush and the second cleaner brush, wherein, when it is determined that the life of either one of the first cleaner brush or the second cleaner brush is ended, the hardware processor switches a bias voltage between the same polarity as or an opposite polarity from a polarity of the toner and applies the bias voltage to the other of the first cleaner brush and the second cleaner brush of which the life has not been determined to be ended.

6. The image forming apparatus according to claim 5, wherein a timing of the switching includes a timing at which the toner on the image carrier passes through a region in which the toner can be removed from the image carrier by the other of the first cleaner brush and the second cleaner brush.

7. The image forming apparatus according to claim 5, wherein the hardware processor determines the number of application times of the bias voltage on the basis of voltage information or current information of the first cleaner brush and the second cleaner brush of when the bias voltage is applied.

8. The image forming apparatus according to claim 5, wherein, when it is determined that the life of either one of the first cleaner brush or the second cleaner brush is ended, the hardware processor applies to the one a bias voltage of the same polarity as a polarity of a bias voltage applied to the other of the first cleaner brush and the second cleaner brush.

9. The image forming apparatus according to claim 5, wherein, when it is determined that the life of either one of the first cleaner brush or the second cleaner brush is ended, the hardware processor applies to the one a bias voltage of an opposite polarity from a polarity of a bias voltage applied to the other of the first cleaner brush and the second cleaner brush.

10. The image forming apparatus according to claim 1, further comprising an image forming part that forms an image by a toner image on a recording medium, wherein the image forming part performs image formation of only the image of a single color when it is determined by the hardware processor that life of both of the first cleaner brush and the second cleaner brush is ended.

11. An image forming apparatus comprising:

an image carrier that carries a toner image;

a cleaning unit that collects a toner on the image carrier; and a hardware processor that controls the cleaning unit, wherein the cleaning unit includes a first cleaner brush and a second cleaner brush that remove the toner from the image carrier, the hardware processor is configured to:

apply bias voltages having opposite polarities to the first cleaner brush and the second cleaner brush, and determine whether life is ended with respect to either one of the first cleaner brush or the second cleaner brush, and when it is determined that the life of the one of the first cleaner brush or the second cleaner brush is ended, the hardware processor further switches a bias voltage between the same polarity as or an opposite polarity from a polarity of the toner and applies the bias voltage to the other of the first cleaner brush or the second cleaner brush of which the life has not been determined to be ended.

12. A control method of a cleaning unit that collects a toner on an image carrier included in an image forming apparatus, the cleaning unit including a first cleaner brush and a second cleaner brush that remove the toner from the image carrier, the control method comprising:

applying bias voltages having opposite polarities to the first cleaner brush and the second cleaner brush; and determining whether life is ended with respect to each of the first cleaner brush and the second cleaner brush, when it is determined that life has not ended for one of the first cleaner brush and the second cleaner brush but has ended for another of the first cleaner brush and the second cleaner brush, operate the one cleaner brush at a first polarity while a region of the image carrier where a toner image is formed passes by the one cleaner brush, and when a trailing end of the region has passed the one cleaner brush, change the polarity of the one cleaner brush.

* * * * *